United States Patent [19]

Rice et al.

[11] 4,032,908

[45] June 28, 1977

[54] SECURITY ALARM SYSTEM

[75] Inventors: Richard C. Rice; Barry N. Horn, both of Milwaukee, Wis.

[73] Assignee: Automated Systems, Inc., Milwaukee, Wis.

[22] Filed: July 2, 1975

[21] Appl. No.: 592,425

[52] U.S. Cl. ..... 340/213 R; 340/412

[51] Int. Cl.[2] ..... G08B 25/00

[58] Field of Search ..... 340/412, 413, 414, 214, 340/415, 213 R; 178/DIG. 38, 66 A, 69 G

[56] References Cited

UNITED STATES PATENTS

| | | | |
|---|---|---|---|
| 3,641,266 | 2/1972 | Stults et al. | 178/DIG. 38 |
| 3,792,466 | 2/1974 | Arnold et al. | 340/365 E |
| 3,812,487 | 5/1974 | Burton | 340/413 |
| 3,900,845 | 8/1975 | Tsuiki et al. | 340/365 E |
| 3,921,168 | 11/1975 | Dunbar | 340/413 |

*Primary Examiner*—Marshall M. Curtis

*Attorney, Agent, or Firm*—Wheeler, Morsell, House & Fuller

[57] ABSTRACT

A plurality of alarm conductors are coupled to a multiplexer which connects the conductors one at a time in sequence to the input of an alarm detector which detects alarm conditions on the conductors. A shift register having the same number of stages as the number of alarm conductors has its input coupled to the multiplexer output and its output coupled back to its input to form a recirculating serial memory. The shift register is clocked in synchronism with the multiplexer. The output of the shift register is selectively coupled through a switchable memory output control to the input of the alarm detector to recall a previous alarm condition on one or more of the alarm conductors. A second shift register having a number of stages equal to an integral multiple of the number of alarm conductors has its input coupled to the output of the alarm detector means. The second shift register is also clocked in synchronism with the multiplexer. An exclusive OR circuit has one input coupled to the output of the second shift register, another input coupled to the output of the alarm detector, and the output coupled to the control means for a data transmitter which transmits the alarm to a remote location. The second shift register and exclusive OR circuit limit the number of times the alarm is transmitted to the remote location.

10 Claims, 3 Drawing Figures

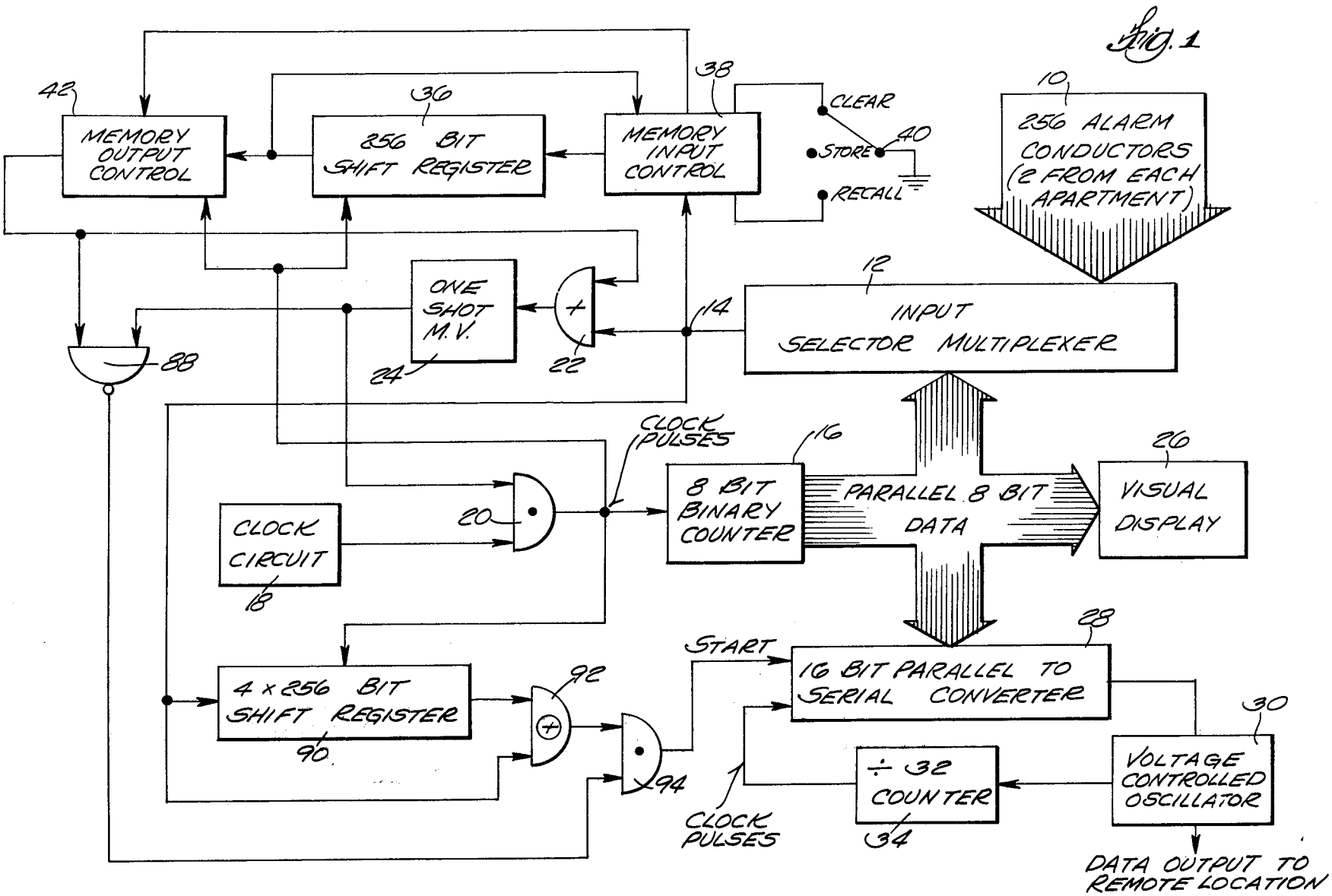
Fig. 1
256 ALARM CONDUCTORS (2 FROM EACH APARTMENT)
10
INPUT SELECTOR MULTIPLEXER
12
VISUAL DISPLAY
26
PARALLEL 8 BIT DATA
16
8 BIT BINARY COUNTER
VOLTAGE CONTROLLED OSCILLATOR
30
DATA OUTPUT TO REMOTE LOCATION
16 BIT PARALLEL TO SERIAL CONVERTER
28
÷ 32 COUNTER
34
START
CLOCK PULSES
CLOCK PULSES
CLEAR
STORE
RECALL
40
MEMORY INPUT CONTROL
38
14
256 BIT SHIFT REGISTER
36
ONE SHOT M.V.
24
22
20
CLOCK CIRCUIT
18
4 × 256 BIT SHIFT REGISTER
90
92
94
MEMORY OUTPUT CONTROL
42
88

DATA INPUT FROM TERMINAL 14 (FIG. 1
CLOCK PULSE INPUT
MEMORY DATA INPUT
90
4 x 256 BIT SHIFT REGISTER
96
98
22
24
ONE SHOT M.V.
100
102
START TRANSMITTER GATE

SECURITY ALARM SYSTEM

BACKGROUND OF THE INVENTION

This invention relates to security alarm systems such as disclosed in our U.S. Pat. No. 3,939,460 issued on Feb. 17, 1976 for a "Security Alarm System".

The above noted copending patent application discloses a security alarm system in which a plurality of burgular and fire alarm conductors from different premises are wired to a multiplexer in a central data transmitter unit. A binary counter is coupled to the multiplexer and a clock pulse circuit is coupled to the binary counter to step the counter through its counting cycle. The counter causes the multiplexer to connect the alarm conductors one at a time in sequence to the input of an alarm detector which detects alarm conditions on the conductors. When an alarm condition is detected, the counter is stopped and the number in the counter at that time is displayed on a visual display in the data transmitter along with a letter signifying whether the alarm is a fire alarm or a burgular alarm. The displayed number, which indicates the premises in which the alarm condition is detected, is also transmitted by the data transmitter to a remote location, e.g., to a police station or fire station. After the alarm condition and number have been displayed and transmitted, the counter is re-activated and resumes stepping the multiplexer through its scanning cycle.

One problem associated with the above described security alarm system is that an alarm condition for any particular alarm conductor is re-transmitted every time the multiplexer scans the corresponding alarm conductor as long as the alarm remains active. For example, if a fire alarm is detected at a certain premises, the fire alarm and number of the premises would be repeatedly transmitted to the fire department on every multiplexer scan until the fire is put out, and perhaps longer, since the fire may short or open the fire alarm conductor and possibly cause the alarm condition to remain until somebody repairs the fire alarm conductor. Such continual re-transmissions of the alarm are unnecessary and undesirable. Accordingly, it is desirable to limit the number of times that any particular alarm is transmitted to the remote location.

Another problem in the prior art security alarm systems is that the person assigned to monitor the data alarm transmitter may not spend all of his or her time at the transmitter and thus might miss one or more of the alarms. For example, the data alarm transmitter may be in an apartment house and the security man for the apartment house may be responsible for monitoring the alarm display and taking the appropriate action. However, such a security man would normally have other duties and might miss an alarm while away from the data transmitter unit. As a result, a small fire which could be easily put out if attended to promptly might engulf the building before the fire fighters arrived. Accordingly, it is desirable to provide an alarm memory in the data transmitter unit with which an operator can recall previous alarms that were registered in his absence.

SUMMARY OF THE INVENTION

In accordance with this invention, a shift register having the same number of stages as the number of alarm conductors is coupled to the output of the multiplexer, the output of the shift register being coupled back to its input to form a re-circulating serial memory unit. The shift register is clocked in synchonism with the multiplexer. A switchable control circuit is provided to apply the output of the shift register to the input of the alarm detector circuit to recall previous alarms. A second shift register having a number of stages equal to an integral multiple of the number of alarm conductors is coupled to the output of the alarm detector circuit. The second shift register is also clocked in synchronism with the multiplexer. An exclusive OR circuit has one input coupled to the output of the second shift register, another input coupled to the output of the alarm detector circuit, and the output connected to a control circuit which activates the data transmitter, thereby limiting the number of times that any particular alarm is transmitted.

DESCRIPTION OF THE DRAWINGS

FIG. 1 is a block diagram of an alarm detector and data transmitter unit utilizing one embodiment of the invention.

DESCRIPTION OF THE PREFERRED EMBODIMENT

Figure 2:
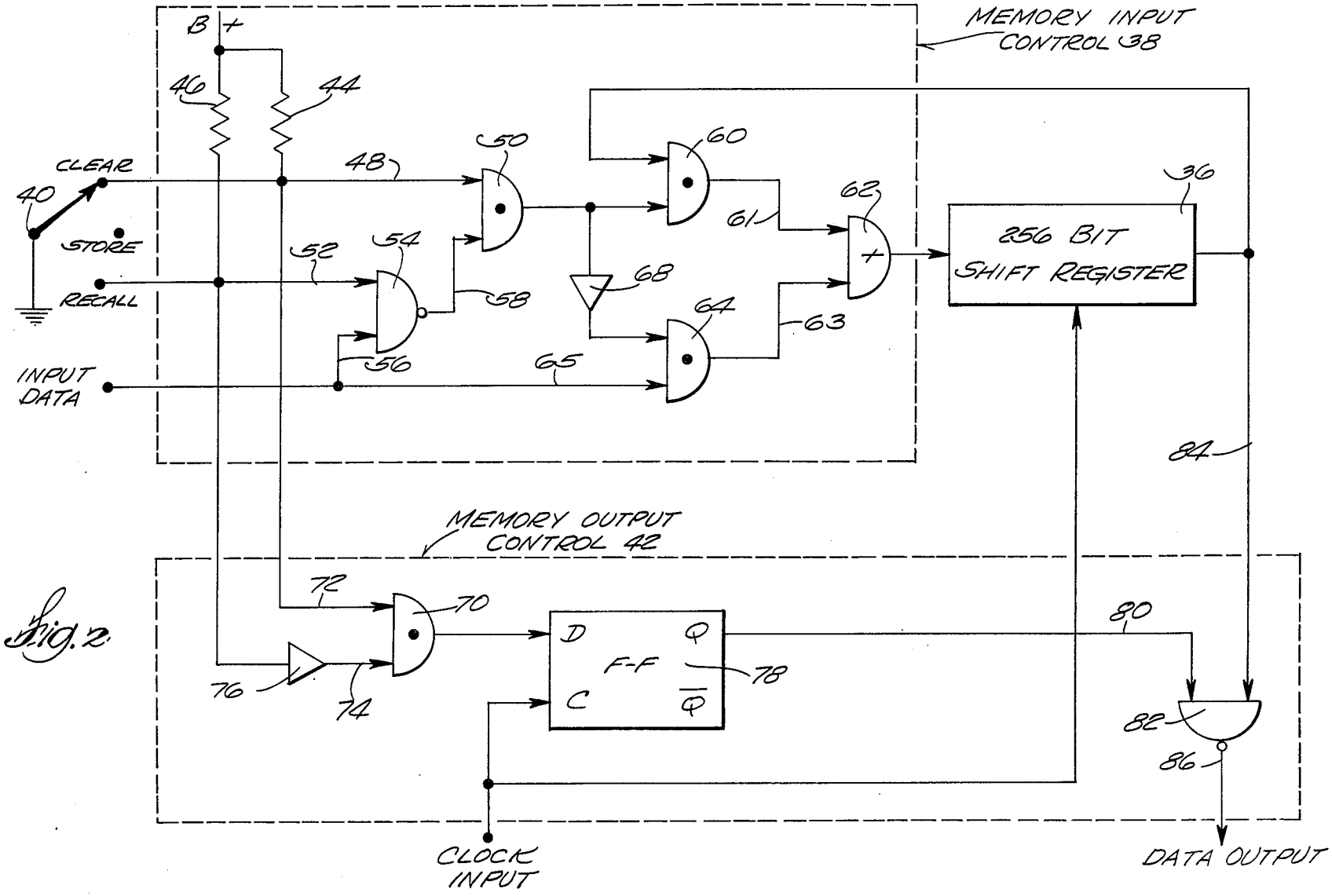
FIG. 2 is a detailed block diagram of the memory input control and memory output control circuits shown in FIG. 1.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

FIG. 1 discloses an alarm detector and data transmitter utilizing one embodiment of the invention. Burglar and fire alarm conductors 10 are wired from 128 different apartments or other premises to an input selector multiplexer 12 which is similar in its construction and operation to the input selector multiplexer disclosed in said copending patent application Ser. No. 463,713. One burglar and one fire alarm detector are wired from each apartment to multiplexer 12, making a total of 256 conductors. Multiplexer 12 steps through a 256 step cycle in which each of the alarm conductors 10 are connected one at a time in sequency to the output terminal 14 of multiplexer 12. Multiplexer 12 is stepped through its cycle by an 8 bit binary counter 16 which is driven by clock pulse circuit 18 through AND gate 20.

The output of multiplexer 12 is applied through OR gate 22 to the input of a one shot multivibrator 24 which acts as an alarm detector circuit. Alarm conductors 10 are normally grounded, which indicates a binary zero, and rise to a positive voltage, which indicates a binary one, when an alarm condition occurs on the corresponding conductor 10. As each alarm conductor 10 is connected in sequence to multiplexer output terminal 14, a binary 0 causes no change in the circuit. However, when a binary 1 is encountered no one of the alarm conductors 10, the binary 1 is passed through OR gate 22 and triggers one shot multivibrator 24, whose negative output is applied to AND gate 20 to disable gate 20 as long as one shot multivibrator 24 remains on. Disabling AND gate 20 stops counter 16 at the number corresponding to the alarm conductor carrying the alarm condition.

The parallel output of counter 16 is applied to a visual display 26 which displays the number that the counter is stopped at, indicating the apartment number that originated the alarm. The parallel output of counter 16 is also applied to a parallel to serial converter 28 which aslo receives other inputs (not shown) to be transmitted to the remote location. A START signal is applied to parallel to serial converter 28 at the time that one shot multivibrator 24 is triggered, by circuit means to be described later. The START signal initiates the operation of converter 28 at the time that counter 16 is stopped. The output of parallel to serial converter 28 is applied to a voltage controlled oscillator 30 which transmits the serial data to a remote location, e.g., to the police station and fire station. The output of oscillator 30 is also applied to a divide by 32 counter 34 whose output is applied as transmitter clock pulses to parallel to serial converter 28. A similar divider circuit in the data receiver at the remote location, shown in said copending patent application Ser. No. 463,713 provides receiver clock pulses which are synchronized with the transmitter clock pulses.

After the entire contents of parallel to serial converter 28 has been transmitted, the transmission ceases. Shortly thereafter, one shot multivibrator 24 switches off, enabling AND gate 20 and resuming the clock pulse input to counter 16. Counter 16 then resumes stepping through its cycle, causing multiplexer 12 to resume scanning the alarm conductors 10 until another alarm condition is detected, whereupon counter 16 is stopped again and the transmission process is repeated.

One important feature of this invention is the inclusion of a memory circuit with which an operator can recall previous alarms that occurred in his or her absence. The memory circuit includes a shift register 36 which has as many stages as the number of input conductors 10, in this case 256. Clock circuit 18 is coupled to shift register 36 through AND gate 20 to drive shift register 36 in synchronism with counter 16 and multiplexer 12. The output of multiplexer 12 is applied to the input of shift register 36 through a memory input control 38 and the output of shift register 36 is coupled back to its input through input control 38 to form a recirculating serial memory. A three position switch 40 having a CLEAR position, a STORE position, and a RECALL position is coupled to memory input control 38 and controls its operation.

In the STORE position of switch 40, input information from multiplexer 12 is entered into shift register 36 and is continuously recirculated therethrough. In the RECALL position of switch 40, the information in shift register 36 is applied via memory output control circuit 42 and OR gate 22 to the input of one shot multivibrator 24, where it produces the same result as an input from multiplexer 12. In the CLEAR position of switch 40, the output of memory output control 42 is inhibited, the re-circulation of data through memory input control 38 is inhibited, and all of the binary ones in shift register 36 are replaced with zeros.

The details of memory input control 38 and memory output control 42 are shown in FIG. 2. The CLEAR and RECALL terminals of switch 40 are coupled via resistors 44 and 46 to a positive voltage which represents a binary 1. The arm of switch 40 is grounded, the ground condition representing a binary 0.

When switch 40 is in the STORE position, a binary 1 is applied to input 48 of AND gate 50, and a binary 1 is applied to input 52 of NAND gate 54. The other input 56 of NAND gate 54 is coupled to the data input from output terminal 14 (FIG. 1) of multiplexer 12. The output 58 of NAND gate 54 is coupled to the second input of AND gate 50. When the output of AND gate 50 is a binary 1, it enables an AND gate 60 which recirculates the output of shift register 36 back to the input thereof through an OR gate 62, which also receives an input from AND gate 64. The binary 1 on the output of AND gate 50 is inverted by an amplifier 68 and applied to one input of AND gate 64, thereby disabling AND gate 64. When the output of AND gate 50 is a binary 0, recirculation of data through AND gate 60 is inhibited and fresh input data is entered through input 65 of AND gate 64.

When switch 40 is in the CLEAR position, a binary 0 is applied to input 48 of AND gate 50, producing a binary 0 output which disables AND gate 60, thereby inhibiting re-circulation of data through shift register 36 and entering all binary 0s via the re-circulation input 61 of OR gate 62. At the same time, any new inputs which occur during the clearing operation are entered via input 63 of OR gate 62. Switch 40 must be left in the CLEAR position long enough for the entire contents of shift register 36 to be recirculated in order to assure that all of the previously entered data is cleared.

In the RECALL position of switch 40, input 48 of AND gate 50 receives a binary 1 from resistor 44 and input 58 of AND gate 50 receives a binary 1 from NAND gate 54. This enables recirculate AND gate 60 and disables AND gate 64. At the same time, AND gate 70 in memory output control 42 receives a binary 1 on input 72 from resistor 44. The other input 74 of AND gate 70 receives a binary 1 from inverting amplifier 76, which receives a binary 0 input from the grounded arm of switch 40. This produces a binary 1 output from AND gate 70 and enters a binary 1 into flip-flop 78, which is clocked in synchronism with shift register 36 by the same clock pulses. On each clock pulse, the binary 1 input to flip-flop 78 is transferred to the Q output thereof, which is coupled to one input 80 of a NAND gate 82 whose other input is coupled to the output of shift register 36. The recalled data is transferred out of shift register 36 through NAND gate 82 and is applied to alarm detector multivibrator 24 (FIG. 1) to display the recalled alarm number.

In the RECALL position of switch 40, the data output of memory output control 42 is applied in parallel to one input of OR gate 22 and to one input of NAND gate 88, whose other input is coupled to the output of one shot multivibrator 24. The output of NAND gate 88 is used to trigger the START signed for parallel to serial converter 28, whereby the data transmission is inhibited during recall, the recalled data only being displayed on visual display 26.

In addition to the above described novel memory feature, this embodiment also includes a novel status change detector circuit for limiting the number of data transmissions for any particular alarm. The status change detector circuit includes a shift register 90 which has a number of stages equal to an integral multiple of the number of alarm conductors, the multiple being the number of times it is desired to repeat the data transmission, which in this case is 4. However, it should be understood that larger or smaller multiples can be used in other embodiments of the invention depending on the number of data transmissions desired.

The input data appearing on the output terminal 14 of multiplexer 12 is applied to the input of shift register 90, whose output is applied to one input of an exclusive OR circuit 92 whose other input is coupled to terminal 14. Exclusive OR circuit 92 produces an output whenever its two inputs differ, the output being applied to one input of an AND gate 94 whose other input is coupled to the output of NAND gate 88. The binary 1 output of AND gate 94 constitutes the START signal for parallel to serial converter 28. When an alarm condition (a binary 1) is first applied to the output terminal 14 of multiplexer 12, exclusive OR gate 92 develops a binary 1 output since its two inputs are different, and thus generates a START signal. On the next three input scan cycles, START signals are also generated. But on the fifth scan cycle, both inputs of exclusive OR gate 92 will be the same, since there will be a binary 1 on the output of shift register 90, thereby developing a binary 0 output on exclusive OR gate 92 that disables AND gate 94 and terminates the data transmission operation. Thus, the data transmission is limited to four transmissions for each alarm condition in this embodiment of the invention. When the alarm condition ceases, exclusive OR gate 92 will develop a binary 1 output on the next four scan cycles as the binary ones enetered in shift register 90 are shifted out, but the START signal will be inhibited by a binary 0 applied to the other input of AND gate 94 from the output of NAND gate 88.

Figure 3:
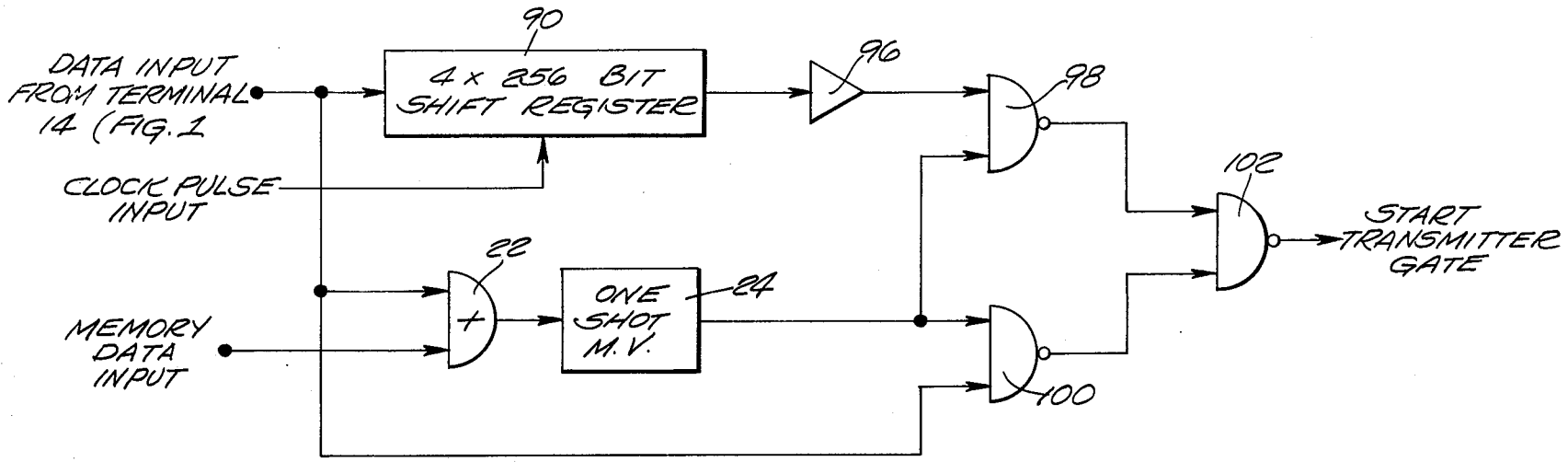
FIG. 3 is a detailed block diagram of an alternate circuit arrangement for limiting the number of alarm transmissions for any specific alarm condition.

FIG. 3 shows another circuit arrangement for limiting the number of data transmissions. This circuit configuration includes three NAND circuits which act as a gated exclusive OR circuit. In this circuit, the output of shift register 90 is inverted by an inverting amplifier 96 and is applied to one input of NAND gate 98 whose other input is coupled to the output of one shot multivibrator 24. The output of one shot multivibrator 24 is also coupled to one input of a NAND gate 100 whose other input is coupled to the data input of shift register 90. The output of one shot multivibrator 24 acts to gate NAND gates 98 and 100 to inhibit the production of a START signal when no data input is present. The outputs of NAND gates 98 and 100 are applied to corresponding inputs of NAND gate 102, whose output signal constitutes the START signal.

We claim:

1. In an alarm system having a plurality of alarm conductors each wired to corresponding premises, a multiplexer coupled to said alarm conductors and containing means for connecting the connectors one at a time in sequence to an output terminal of the multiplexer, a binary counter coupled to said multiplexer to cycle the same through its sequence, a clock pulse circuit coupled to said binary counter to drive the same, alarm detector means coupled to the output of said multiplexer for detecting an alarm condition on any one of said alarm conductors, and display means coupled to said alarm detector means for visually identifying the alarm conductor upon which an alarm condition is detected, an alarm memory comprising a shift register coupled to the output of said multiplexer, said shift register having the same number of stages as the number of alarm conductors, said clock pulse circuit being coupled to said shift register to drive the same in synchronism with said multiplexer, the output of said shift register being coupled back to the input thereof to form a recirculating serial memory, and output circuit means coupled between the output of said shift register and the input of said alarm detector means for selectively applying the output of said shift register to the input of said alarm detector means to recall a previous alarm condition on one or more of said alarm conductors.

2. The alarm system defined in claim 1 and also including means coupled to the input of said shift register for clearing said recirculating serial memory formed thereby.

3. The alarm system defined in claim 1 and also including switchable input circuit means coupled to the input of said shift register, said switchable input circuit means being switchabel between a first condition in which data from the output of said shift register is recirculated to the input thereof and entry of new data to the input of said shift register is inhibited and a second condition in which new data is entered into the input of said shift register and entry of recirulated data is inhibited.

4. The alarm system defined in claim 3 wherein said output circuit means is switchable between a first condition in which the output of said register is applied to the input of said alarm detector means and a second condition in which the output of said shift register is not applied to the input of said alarm detector means.

5. The alarm system defined in claim 4 and also including common switching means coupled to said input and output circuit means to switch the same between said first and second conditions thereof.

6. The alarm system defined in claim 5 in which said switching means comprising a single pole three position switch, the arm of said switch being grounded to represent a binary 0 a voltage representing a binary 1 being coupled in series with a first resistor to a first terminal of said switch, a voltage representing a binary 1 being coupled in series with a second resistor to a second terminal of said switch, and wherein said output circuit means includes an AND circuit having one input coupled to said first switch terminal and a second input coupled through an inverter to said second switch terminal, a flip-flop having one input coupled to the outer of said AND circuit, said flip-flop having a clock input coupled to the output of said clock circuit to clock said flip-flop in synchronism with said shift register, and a NAND circuit having one input coupled to the output of said shift register and another input coupled to an output of said flip-flop, the output of said NAND circuit being coupled to the input of said alarm detector means.

7. The alarm system defined in claim 6 wherein said input circuit means includes a NAND circuit having one input coupled to said first switch terminal and another input coupled to the output of said multiplexer, a first AND circuit having one input coupled to said second switch terminal and another input coupled to the output of said NAND circuit, a second AND circuit having one input coupled to the output of said first AND circuit and another input coupled to the output of said shift register, a third AND circuit having one input coupled through an inverter to the output of said first AND circuit and another input coupled to the output of said multiplexer, and an OR circuit having one input coupled to the output of said second AND circuit and another input coupled to the output of said third AND circuit, and the output of said OR circuit being coupled to the input of said shift register.

8. In an alarm system having a plurality of alarm conductors each wired to corresponding premises, a multiplexer coupled to said alarm conductors for connecting the conductors one at a time in sequence to an output terminal of the mulitplexer, a binary counter coupled to said mulitplexer to cycle the same through its sequence, a clock pulse circuit coupled to said binary counter to drive the same, alarm detector means coupled to the output of said multiplexer for detecting an alarm condition on any one of said alarm conductors, data transmitter means coupled to the output of said alarm detector means for transmitting the alarm to a remote location, and transmitter control means for controlling the action of said data transmitter, a status change detector comprising a shift register coupled in series between the output of said alarm detector and the input of said transmitter control means, the number of stages in said shift register being an integral multiple of the number of alarm conductors, and an exclusive OR circuit having one input coupled to the output of said multiplexer and the other input coupled to the output of said shift registers, the output of said exclusive OR circuit being coupled to the input of said transmitter control means to actuate the same, thereby limiting the number of times that the alarm is transmitted by said data transmitter for any alarm conductor.

9. The alarm system defined in claim 8 and also including an AND circuit having one input coupled to the output of said exclusive OR circuit and another input coupled to the output of said alarm detector means, the output of said AND circuit being coupled to the input of said transmitter control means to actuate the same, said exclusive OR circuit being coupled to said transmitter control means through said AND circuit.

10. The alarm system defined in claim 8 wherein said exclusive OR circuit is formed by three NAND circuits each having two inputs and an output, one input of the first NAND circuit being coupled through an inverter to the output of said shift register, the other input of said first NAND circuit being coupled to the output of said alarm detector means, one input of the second NAND circuit being coupled to the output of said alarm detector means and the other input being coupled to the input of said shift register, one input of the third NAND circuit being couple to the output of the first NAND circuit and the other input of the third NAND circuit being coupled to the output of the second NAND circuit, and the output of said third NAND circuit being coupled to the input of said transmitter control means to actuate the same.

* * * * *

UNITED STATES PATENT AND TRADEMARK OFFICE

CERTIFICATE OF CORRECTION

PATENT NO. : 4,032,908

DATED : June 28, 1977

INVENTOR(S) : Richard C. Rice and Barry N. Horn

It is certified that error appears in the above-identified patent and that said Letters Patent are hereby corrected as shown below:

Column 7, line 16, "controlling the action" should be changed to ---controlling the actuation---

Column 7, line 25, "output of said shift registers" should be changed to ---output of said shift register---

Column 8, line 21, "third NAND circuit being couple" should be changed to ---third NAND circuit being coupled---

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*